United States Patent [19]

Schmertz

[11] Patent Number: 5,008,140

[45] Date of Patent: Apr. 16, 1991

[54] BIAXIALLY CORRUGATED FLEXIBLE SHEET MATERIAL

[76] Inventor: John C. Schmertz, 5308 Ellsworth Ave., Pittsburgh, Pa. 15232

[21] Appl. No.: 359,540

[22] Filed: Jun. 1, 1989

[51] Int. Cl.[5] ..... B32B 3/28

[52] U.S. Cl. ..... 428/179; 428/182; 428/183; 428/192; 428/603

[58] Field of Search ..... 428/156, 167, 172, 174, 428/176, 177, 179, 182, 183, 192, 457, 474.4, 480, 492, 500, 532, 537.5, 603; 52/795, 807, 630; 206/814; 410/154, 155; 229/90

[56] References Cited

U.S. PATENT DOCUMENTS

| | | | |
|---|---|---|---|
| 3,168,432 | 2/1965 | Elfving | 161/69 |
| 3,433,692 | 3/1969 | Gewiss | 156/197 |
| 3,461,013 | 8/1969 | Gewiss | 156/210 |
| 3,698,879 | 10/1972 | Lucien | 428/186 |
| 3,992,162 | 11/1976 | Gewiss | 428/179 |
| 4,516,891 | 5/1985 | Wnuk et al. | 410/154 |
| 4,689,261 | 8/1987 | Ahnsfrom | 428/183 |

*Primary Examiner*—Ellis P. Robinson
*Assistant Examiner*—Donald J. Loney
*Attorney, Agent, or Firm*—Harold M. Dixon; William R. Moser; Richard E. Constant

[57] ABSTRACT

A flexible biaxially corrugated sheet material is formed from a plurality of identical trapezium segments which are arranged in a plurality of long strips a single segment wide. Adjacent strips are mirror images of each other and connected along adjoining sides with the angles of the four corners of adjacent segments being alternately less than 360° and greater than 360° along the length of a strip such that the sheet material has an undulating configuration, and is inherently curved and cannot lie in a flat plane.

4 Claims, 3 Drawing Sheets

BIAXIALLY CORRUGATED FLEXIBLE SHEET MATERIAL

BACKGROUND OF THE INVENTION

The invention relates to a biaxially corrugated flexible sheet material, and, more particularly, to such a sheet material that is formed of a plurality of trapezium segments.

Several types of sheet material are currently used to form items such as seals, bellows, and the like. These materials are typically corrugated along one axis in order to give the structure strength and flexibility. The materials must be curved, such as when used in a cylinder, and be expandable. Currently such materials are generally flexible in only one direction, so that when the material is pulled axially, the diameter of the structure into which the material has been formed decreases slightly.

One type of corrugated sheet material is disclosed in U.S. Pat. No. 3,992,162. That sheet material is described for use as a building material, thus, it is not particularly necessary that the sheet material be flexible. The herringbone corrugation pattern described therein is formed from a plurality of abutting elementary surfaces, the sides of which are contiguous and the corners of which meet at points, which when the material is corrugated, form peaks and valleys. The sum of the angles of the corners of the elementary surfaces at each point is 360° so that the sheet material can lie in a flat plane, but cannot follow an initially curved surface.

An object of the invention is to develop a flexible sheet material that is flexible in the direction of its length and width, so that it can expand in both directions at once. Further, it is desired to develop such a material wherein the flat planes of the segments of the sheet material fit together to form an initially curved shape.

SUMMARY OF THE INVENTION

With this object in view, the present invention resides in a flexible biaxially corrugated sheet material formed from a plurality of identical trapezium segments. Each trapezium segment has four edges and four corners formed at the juncture of the edges. Two edges meet at an angle to form each corner.

The trapezium segments are arranged in a plurality of elongated strips. Each strip is a single trapezium segment wide and has first and second opposed sides formed by the free edges of the trapezium segments in the strip. Adjacent strips are mirror images of each other and are connected to each other along their adjoining sides so that the edges of adjacent trapezium segments meet and four corners of four adjacent trapezium segments meet at a point. The sum of the angles of the four corners at each point are alternately less than 360° and greater than 360° along the length of the adjacent strips.

The sheet material has an undulating configuration of alternating ridges and valleys, is inherently curved, and cannot lie in a flat plane.

The sheet material is flexible in two directions and has improved flexibility in the axial direction than other currently available types of corrugation patterns.

DESCRIPTION OF THE DRAWINGS

The invention will become more readily apparent from the following description of a preferred embodiment thereof shown by way of example only, in the accompanying drawings, wherein.

DETAILED DESCRIPTION OF THE PREFERRED EMBODIMENTS

Figure 1:
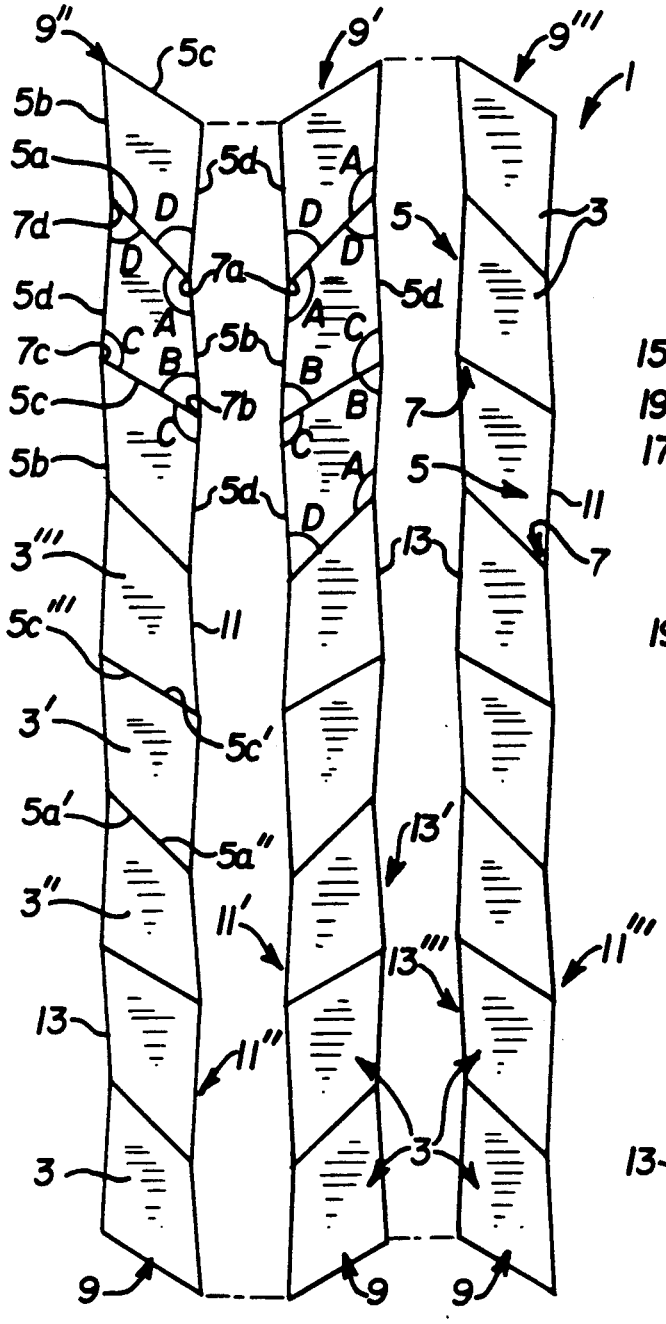
FIG. 1 is a plan view of three adjacent elongated strips of trapezium segments used to form the sheet material of the invention.
Figure 2:
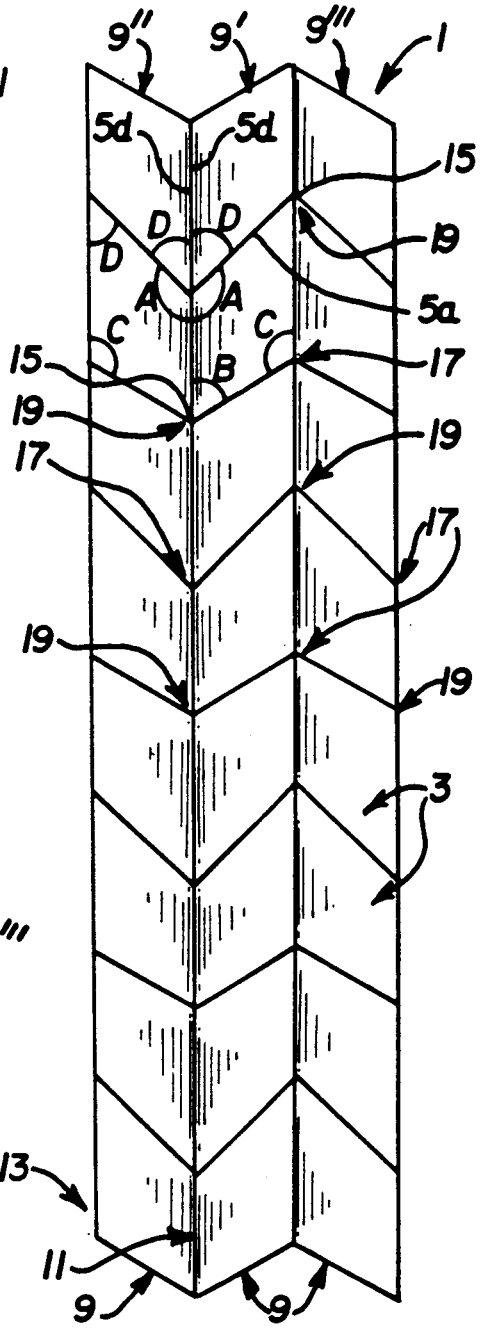
FIG. 2 is a plan view of the three adjacent elongated strips of trapezium segments of FIG. 1 shown connected together.
Figure 3:
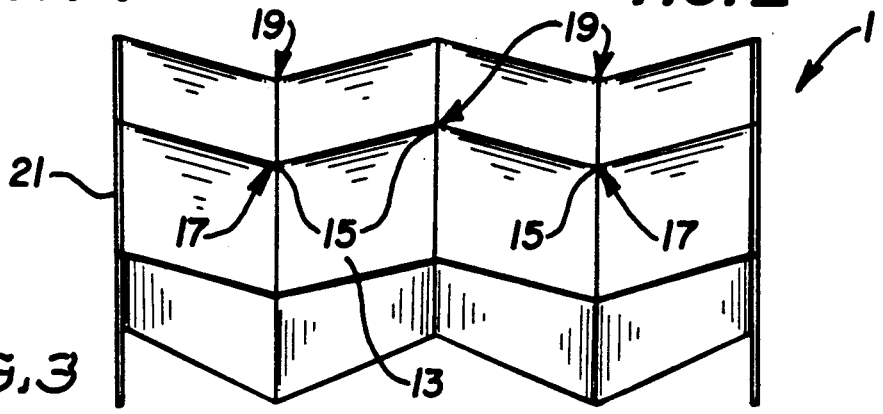
FIG. 3 is an elevational view of a sheet material formed of the elongated strips of FIG. 1.
Figure 4:
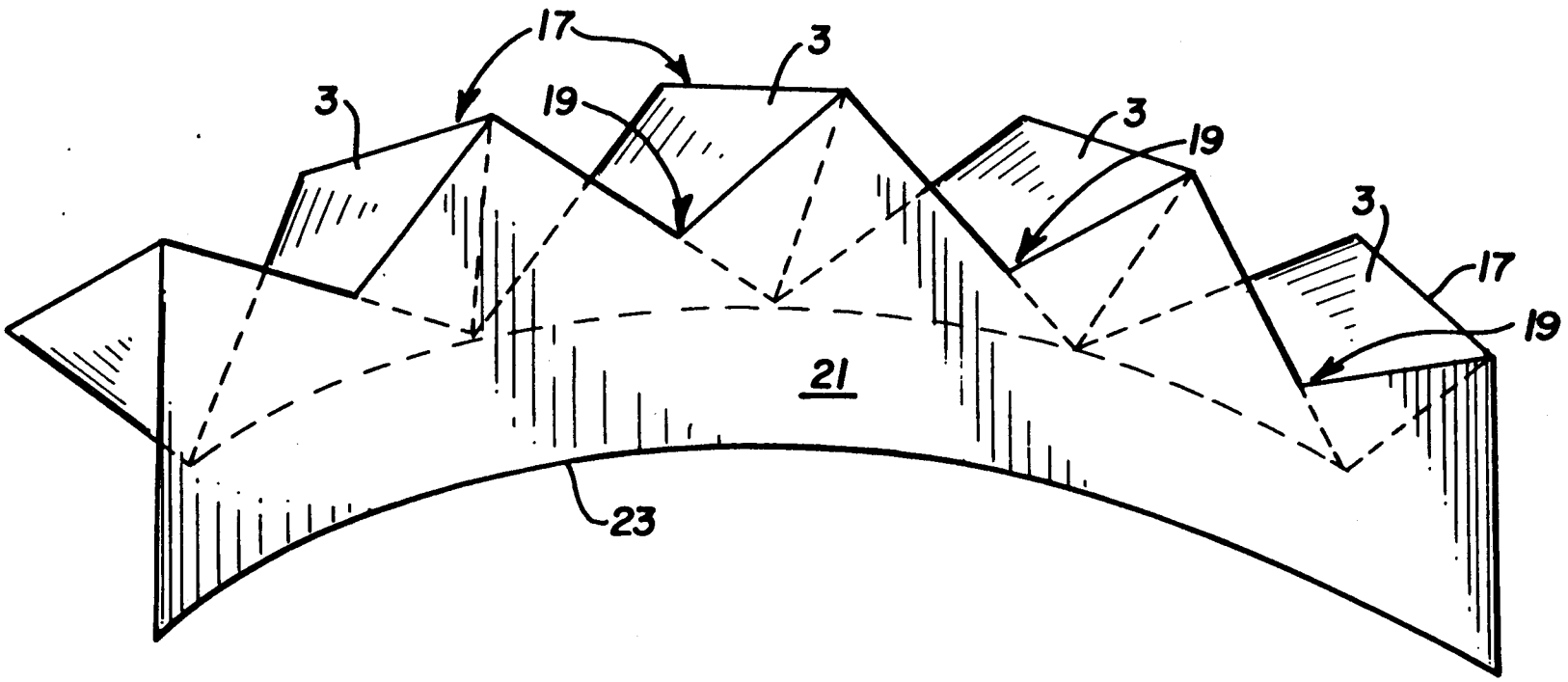
FIG. 4 is an isometric view of the sheet material of the invention illustrating it in an initially curved cylindrical configuration with transition members used to attach the sheet material to a curved surface.
Figure 5:
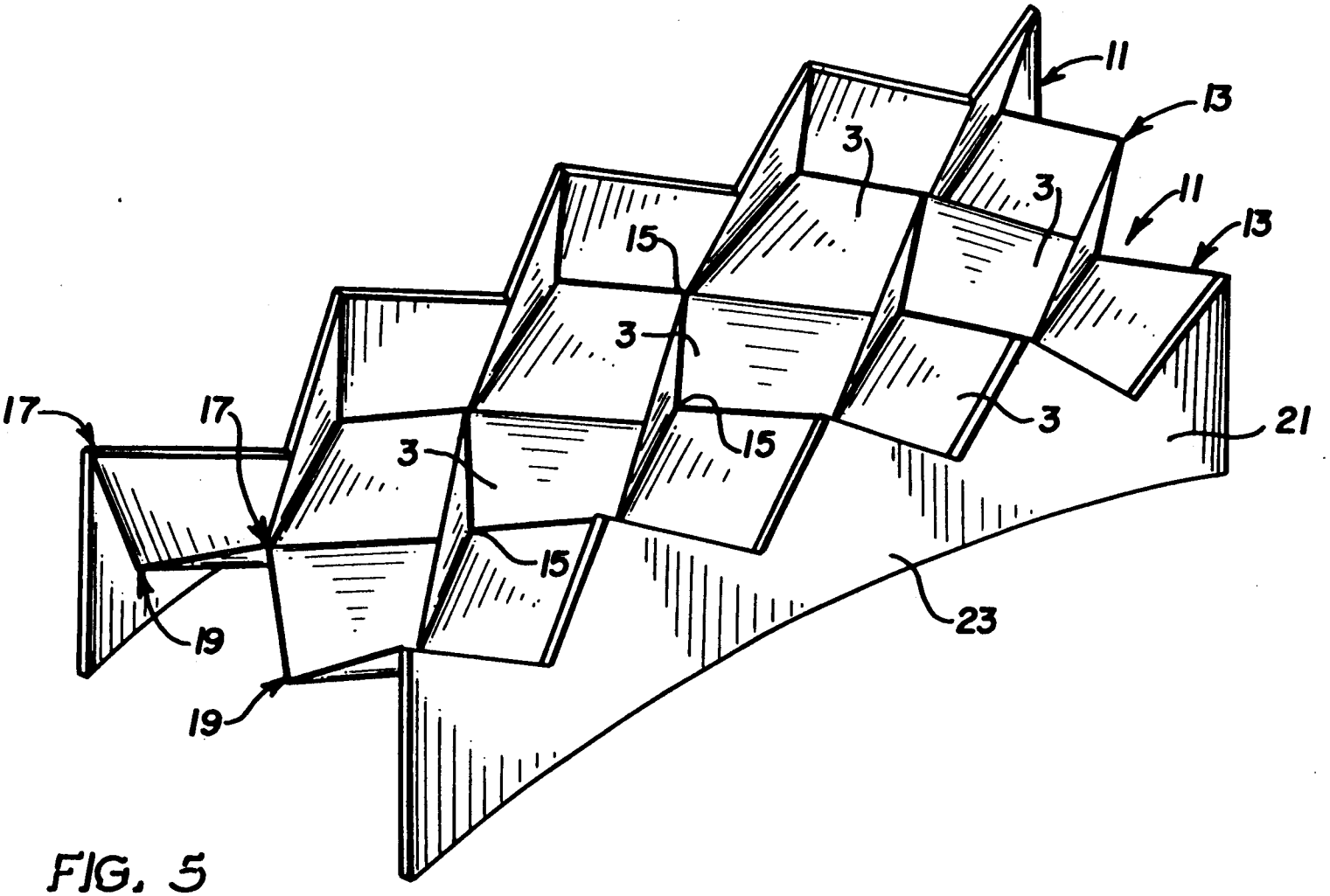
FIG. 5 is a perspective view of the sheet material of the present invention illustrating the alternating peaks and valleys and the transition members.

The flexible sheet material 1 of the present invention is formed of a plurality of identical trapezium segments 3. The trapezium segments 3 are quadrilaterals which do not have any parallel edges. Each of the trapezium segments 3 have four edges 5, specifically labeled 5*a*, 5*b*, 5*c* and 5*d*, and four corners 7, specifically labeled 7*a*, 7*b*, 7*c* and 7*d*, formed at the juncture of the edges 5 so that the edges 5 extend between the corners 7. Two contiguous edges 5 meet at an angle, specifically A, B, C and D, to form each corner 7. As shown in FIGS. 1 and 2, edges 5*a* and 5*b* meet at an angle A to form the corner 7*a*, edges 5*b* and 5*c* meet at an angle B to form the corner 7*b*, edges 5*c* and 5*d* meet at an angle C to form the corner 7*c*, and edges 5*d* and 5*a* meet at an angle D to form the corner 7*d*. None of the edges 5 can be parallel to another edge 5 in a trapezium segment 3, and the length of the edges 5*a*, 5*b*, 5*c* and 5*d* cannot all be the same, nor can the length of the opposed edges 5*a* and 5*c* be equal at the same time that the length of the opposed edges 5*b* and 5*d* are equal. Similarly, the angles A, B, C and D cannot all be the same, nor can the sum of the angles A and B be 180° at the same time that the sum of the angles C and D is 180°. The length of the edges 5 and size of the angles can all be different.

The trapezium segments 3 are arranged in a plurality of elongated strips 9, illustrated as three strips 9', 9'' and 9''' in the figures. Each strip 9 is a single trapezium segment 3 wide and has first and second opposed sides 11 and 13, respectively, formed by the free edges 5*b* and 5*d* of the trapezium segments 3 in the strip 9, as shown in FIGS. 1 and 2. As illustrated in the figures, each trapezium segment 3 in a strip 9 is connected to adjacent trapezium segments, with three such strips 3, designated 3', 3'' and 3''', along opposed edges 5 of the trapezium segment 3, rather than contiguous edges 5. While the trapezium segments 3', 3'' and 3''' are labeled differently, they are identical. Trapezium segments 3'' and 3''' are oriented at 180° with respect to the trapezium segment 3'. As shown in FIGS. 1 and 2, the edge 5*a'* of a trapezium segment 3' in a strip 9'' is connected to the edge 5*a''* of one of the adjoining trapezium segments 3'' and the edge 5*c'* of the trapezium segment 3' is connected to the edge 5*c'''* of the other of the adjoining trapezium segments 3'''.

As shown in FIGS. 1 and 2, strip 9' is a mirror image of adjacent strips 9'' and 9'''. The strips 9', 9'' and 9''' are connected to each other along their adjoining sides 11', 11" and 13', 13"', respectively, so that the edges 5 of adjacent trapezium segments 3 meet and four corners 7 of four adjacent trapezium segments 3 meet at a point 15. While the strips 9" and 9"' are labeled differently, they are identical and are mirror images of the strip 9'.

It is critical to the present invention that the sum of the angles of the four corners 7 at each point 15 are alternately less than 360° and greater than 360° along the length of adjacent strips 9. As shown in FIG. 1, alternately the sums of the angles are the sum of angles A, A, D, and D, and the sum of the angles B, B, C and C. Typically, the sum of the angles of the four corners 7 is alternately between about 300° and about 320° and between about 420° and about 400° along the length of the adjacent strips 9. The sheet material 1 has an undulating configuration of alternating ridges 17 and valleys 19 to provide flexibility along both its length and its width, as shown in FIGS. 2 to 5.

The sheet material 1 is inherently curved and cannot lie in a flat plane. Thus, the sheet material can be formed into a variety of curved configurations, such as a cylinder, saddle, and sphere, depending upon the intended use of the sheet material 1. Since the sheet material is in a curved configuration and has an undulating configuration of alternating ridge and valley, transition elements 21 are provided which have a curved end surface 23 to enable securement thereto to a surface of a substrate to which the sheet material is to be fixed. While only two such transition elements 21 are illustrated in the drawings in parallel relationship, two other such transitional elements may be provided in the transverse direction to provide a transition element boundry for the sheet material.

The sheet material 1 is versatile and can be used to provide structural flexibility for seals, such as pressure activated seals, bellows, such as blow molded bellows, actuators, protective bellows type covers, peristalic pumps, fillers and the like. If made of fabric, the sheet material 1 can also be used to fit the same piece of clothing, such as a sweater, to people of different sizes.

The sheet material 1 can be formed of various flexible materials such as plastic, metal, fabric, felt, papers and other cellulosic materials, rubber, cloth fabric, and the like, depending on the intended use of the sheet material 1.

What is claimed is:

1. A biaxially flexible corrugated sheet material comprising a plurality of identical trapezium segments, each said trapezium segment having four edges and four corners formed at the juncture of said edges, two said edges meeting at an angle to form each said corner;

said trapezium segments being arranged in a plurality of elongated strips, each said strip being a single trapezium segment wide and having first and second opposed sides formed by the free edges of said trapezium segments in said strip;

adjacent said strips being mirror images of each other and being connected to each other along their adjoining sides so that the edges of adjacent said trapezium segments meet and four said corners of four adjacent trapezium segments meet at a point, the sum of the angles of said four corners at each said point being alternately less than 360° and greater than 360° along the length of said adjacent strips;

whereby said sheet material has an undulating configuration of alternating ridges and valleys, is inherently curved, and cannot lie in a flat plane.

2. The corrugated sheet material of claim 1 wherein said edges of said sheet material include a transition layer having a curved end surface.

3. The corrugated sheet material of claim 1 in which the sum of the angles of said four corners at each said point are alternately between about 300° and about 320° and between about 420° and about 400° along the length of said adjacent strips.

4. The corrugated sheet material of claim 1 in which the sheet material is formed of a material selected from the group consisting of plastic, metal, fabric, felt, paper and other cellulosic materials, cloth, and rubber.

* * * * *